US005929566A

United States Patent [19]

Azami

[11] Patent Number: 5,929,566

[45] Date of Patent: Jul. 27, 1999

[54] COLLECTOR STRUCTURE FOR A TRAVELLING-WAVE TUBE HAVING OXIDE FILM ON COOLING FINS

[75] Inventor: Takeshi Azami, Tokyo, Japan

[73] Assignee: NEC Corporation, Japan

[21] Appl. No.: 08/829,200

[22] Filed: Mar. 31, 1997

[51] Int. Cl.[6] ..... H01J 23/033

[52] U.S. Cl. ..... 315/5.38; 313/45; 313/46

[58] Field of Search ..... 315/5.38; 313/45, 313/46

[56] References Cited

U.S. PATENT DOCUMENTS

| | | | |
|---|---|---|---|
| 3,666,980 | 5/1972 | Jackson | 313/46 X |
| 4,054,811 | 10/1977 | Huber et al. | 315/5.38 X |

FOREIGN PATENT DOCUMENTS

| | | | |
|---|---|---|---|
| 0376827 | 12/1989 | European Pat. Off. . | |
| 0505862 | 9/1992 | European Pat. Off. . | |
| 4032136 | 4/1992 | Germany | 315/5.38 |
| 3138883 | 4/1993 | Germany | 315/5.38 |
| 63-45895 | 2/1988 | Japan . | |

OTHER PUBLICATIONS

Patent Abstracts of Japan; vol. 008, No. 216 (M–329), Oct. 3, 1984 & JP 59 100348 (Sharp KK), Jun. 9, 1984.

M. F. Rose et al.: "Novel Techniques for the Thermal Management of Space–based, High–Power Microwave Tubes" IEEE Transactions on Electron Devices, vol. 38, No. 10, Oct. 1, 1991, pp. 2252–2263.

Database WPI Week 8815 1988; Derwent Publications Ltd. London, GB; AN 88–100635 XP002036863 & JP 63 045 895 A (Showa Aluminum Co. Ltd), Feb. 26, 1988.

*Primary Examiner*—Benny T. Lee

*Attorney, Agent, or Firm*—Ostrolenk, Faber, Gerb & Soffen, LLP

[57] ABSTRACT

A collector for a travelling-wave tube includes a collector core and a fin structure surrounding the core and having a plurality of fins for heat radiation. An oxide film having a thickness of greater than 50 $\mu$m inclusive is formed on the outer periphery of the fin structure by anodization and has the maximum surface roughness of 12 $\mu$m inclusive. When the 50 $\mu$m or thicker oxide film is sealed or when a 45 $\mu$m or thicker oxide film is formed and sealed, the oxide film is provided with the maximum surface roughness of greater than 12 $\mu$m inclusive. The collector with any one of such structures achieves an emissivity of 0.90 or above and can efficiently radiate heat generated by the tube in the space.

3 Claims, 6 Drawing Sheets

SURFACE ROUGHNESS 1~3μm
SURFACE ROUGHNESS 12~14μm
WITHOUT SEALING
0.92
0.90
0.85
0.80
EMISSIVITY ε
0
5
10
20
30
40
50
60
THICKNESS OF OXIDE FILM

FILM THICKNESS 50μm
WITHOUT SEALING
0.92
0.90
0.88
EMISSIVITY ε
1
3
6
9
12
14
18
20
MAX SURFACE ROUGHNESS Rmax OF OXIDE FILM ◆ SURFACE ROUGHNESS 1~3μm
▶ SURFACE ROUGHNESS 12~14μm
WITH SEALING
0.92
0.90
0.85
0.80
EMISSIVITY ε
0
5
10
20
30
40
50
60
THICKNESS OF OXIDE FILM FILM THICKNESS 45μm
WITH SEALING
EMISSIVITY ε
0.92
0.90
0.88
1
3
6
9
12
14
18 20
MAX SURFACE ROUGHNESS Rmax OF OXIDE FILM

COLLECTOR STRUCTURE FOR A TRAVELLING-WAVE TUBE HAVING OXIDE FILM ON COOLING FINS

BACKGROUND OF THE INVENTION

The present invention relates to the structure of a collector included in a radiation cooling type high output travelling-wave tube mounted on a satellite.

Travelling-wave microwave tubes for satellite applications are extensively used for satellite broadcasting and microwave communication using satellites. This kind of tube includes an electron gun, a wave delay circuit, and a collector. While the electron gun emits an electron beam, the wave delay circuit substantially equalizes the phase velocity of an electromagnetic wave to the electron velocity of the electron beam. The collector transforms the kinetic energy of the electron beam to heat, and radiates the heat to the outside. To insure the long-term high-output operation of the tube in the space, it is necessary that heat output from the collector be prevented from elevating the temperature of the body of a satellite on which the tube is mounted.

In light of the above, use has customarily been made of a radiation cooling type travelling-wave tube having a collector core protruded to the outside of the structural body of a satellite. In this condition, heat output from the collector is directly radiated into the space with the result that a thermal load on the collector is reduced. For example, the collector or heat radiating means of this type of tube has a collector core formed of copper, collector electrodes disposed in the core, and a ceramic coating film covering the outer periphery of the core. The heat radiation effect available with the tube is expressed in terms of the emissivity $\epsilon$ of the ceramic coating film. The emissivity $\epsilon$ is an extremely important factor because the tube mounted on a satellite is operated in space.

Table 1 shown below lists some specific emissivities of the ceramic coating film.

TABLE 1

| SAMPLE | FILM THICKNESS $\mu$m | EMISSIVITY $\epsilon$ |
|---|---|---|
| $MgO—AL_2O_3$ (Magnesia—Alumina) | 500 | 0.85 |
| $TiO_2—AL_2O_3$ (Titania—Alumina) | 500 | 0.86 |
| $Cr_2O_3$ (Chromium Oxide) | 500 | 0.86 |

For a coating method using flame-spraying, a 500 $\mu$m thick ceramic coating film is generally used. A series of studies by the present inventor showed that the thickness of 500 $\mu$m is optimal. Specifically, thicknesses greater than 500 $\mu$m caused the film to easily comes off while thicknesses smaller than 500 $\mu$m reduced the emissivity in proportion thereto.

As shown in Table 1, the emissivity $\epsilon$ was found to be 0.85 with a magnesia-alumina sample, 0.86 with a titania-alumina ceramic sample, or 0.86 with a chromium oxide sample. That is, the maximum emissivity $\epsilon$ available with ceramic coating films is 0.86.

However, in parallel with the increasing output of the tube for use in a satellite, the required emissivity is increasing. Extended studies by the present inventor showed that an emissivity $\epsilon$ of greater than or equal to 0.90 is essential in order to insure the long-term operation of the tube in space. In this respect, the emissivity $\epsilon$ achievable with the above conventional ceramic coating films cannot implement the sufficient heat radiation currently required of the collector of the tube. Moreover, the film usually 500 $\mu$m thick is apt to crack or come off when subjected to mechanical vibration.

To radiate the heat output from the collector, the collector may be painted or provided with an organic thin film thereon. This kind of scheme, however, brings about a critical problem that the emissivity falls due to its limited resistivity to ultraviolet rays and cosmic dust.

In this manner, considering the application of the collector or radiator to satellites, the collector must be reduced in weight, be reliable under the severe environmental conditions including mechanical vibration and temperature, and in addition be stable with respect to heat radiation and resistivity to ultraviolet rays.

On the other hand, Japanese Patent Laid-Open Publication No. 63-45895, for example, teaches a method capable of providing an aluminum circuit board with a high heat radiating ability and insulating ability by reducing the thickness of an adhesive resin layer. A technology of the kind forming an insulating oxide film (sulfate film) on an aluminum surface by sulfuric anodization and forming an adhesive resin film via the sulfate film is conventional. The problem with this kind of technology is that the adhesion between the resin layer and the circuit board, particularly during heating, is too weak to prevent copper foil or a similar member from coming off during, e.g., soldering of circuit parts. The method taught in the above document is a solution to this problem. Specifically, to insure adhesion between the circuit board and the resin layer and therefore copper foil or the like, the method is characterized in that the surface of the circuit board is roughened to the maximum surface roughness Rmax of 8+3 $\mu$m, and then a 3 $\mu$m to 20 $\mu$m thick oxide film is formed on the roughened surface by anodization.

The present inventor has applied the above prior art method to the fins of a collector. Specifically, a 3 mm thick aluminum film formed of JIS (Japanese Industrial Standard) 1100 alloy had its surface roughened to the maximum surface roughness Rmax of 5 $\mu$m to 11 $\mu$m, and then the roughened surface was anodized to form a 20 $\mu$m oxide film. The experiment showed that the maximum emissivity $\epsilon$ available with such fins is only 0.81 which is even lower than the emissivity of the ceramic coating film. Therefore, this kind of scheme alone cannot provide a collector with the required emissivity alone.

SUMMARY OF THE INVENTION

It is therefore an object of the present invention to provide a collector structure for a travelling-wave tube capable of achieving a far higher emissivity than the conventional ceramic coating film.

In accordance with the present invention, in a collector of a travelling-wave tube and comprising a collector core and a fin structure provided on the outer periphery of the collector core, an oxide film having a thickness preselected in accordance with a desired emissivity is formed by anodization on the outer periphery of the fin structure and provided with a preselected maximum surface roughness.

Also, in accordance with the present invention, in a collector of a travelling-wave tube and comprising a collector core and a fin structure provided on the outer periphery of the collector core, an oxide film having a thickness of substantially greater than 50 $\mu$m is formed by anodization on the outer periphery of the fin structure and provided with a maximum surface roughness of substantially greater than 12 $\mu$m.

Further, in accordance with the present invention, in a collector of a travelling-wave tube and comprising a collector core and a fin structure provided on the outer periphery of the collector core, an oxide film having a thickness of substantially greater than 45 μm is formed by anodization on the outer periphery of the fin structure core, and sealed, and provided with a maximum surface roughness of substantially greater than 12 μm.

Moreover, in accordance with the present invention, a collector of a travelling-wave tube and comprising a collector core and a fin structure provided on the outer periphery of the collector core, an oxide film having a thickness of substantially greater than 50 μm is formed by anodization on the outer periphery of said fin structure, and sealed, and provided with a maximum surface roughness of substantially greater than 12 μm.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
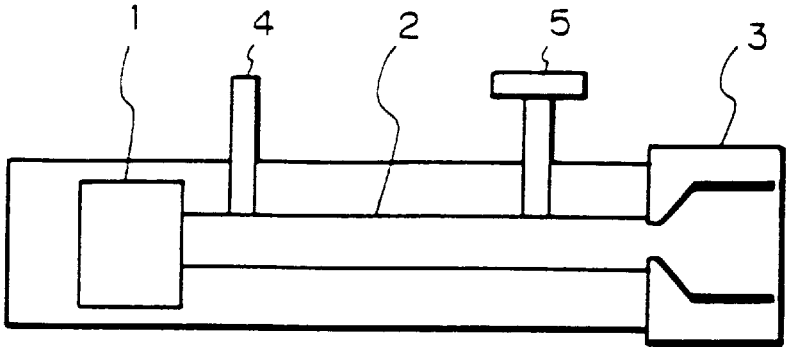
Fig. 1 PRIOR ART
FIG. 1 shows a conventional radiation cooling type travelling-wave tube.
Figure 2:
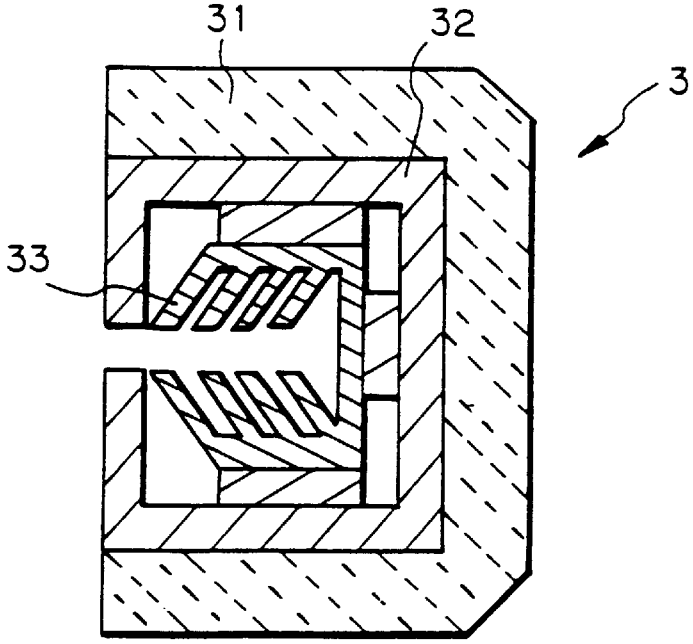
Fig. 2 PRIOR ART
FIG. 2 is a fragmentary section of a collector included in the tube shown in FIG. 1.

To better understand the present invention, reference will be made to a conventional radiation cooling type travelling-wave tube, shown in FIG. 1. As shown, the tube has an electron gun 1, a wave delay circuit 2, a collector 3, a high frequency (RF) input terminal 4, and an RF output terminal 5. The wave delay circuit 2 substantially equalizes the phase velocity of an electromagnetic wave to the electron velocity of an electron beam issuing from the electron gun 1. For example, the wave delay circuit 2 may be implemented by a spiral circuit having a broad band width and a simple structure. As shown in FIG. 2, the collector 3 has a collector core 32 formed of copper, collector electrodes 33 disposed in the core 32, and a ceramic coating film 31 formed on the outer periphery of the core 32.

The heat radiation effect available with the above travelling-wave tube is expressed in terms of the emissivity $\epsilon$ of the ceramic coating film 31. The emissivity $\epsilon$ is an extremely important factor because the tube mounted on a satellite is operated in space, as stated earlier. On the other hand, the ceramic coating 31 surrounding the core 32 cannot implement the previously mentioned condition of $\epsilon \geqq 0.90$.

Figure 3:
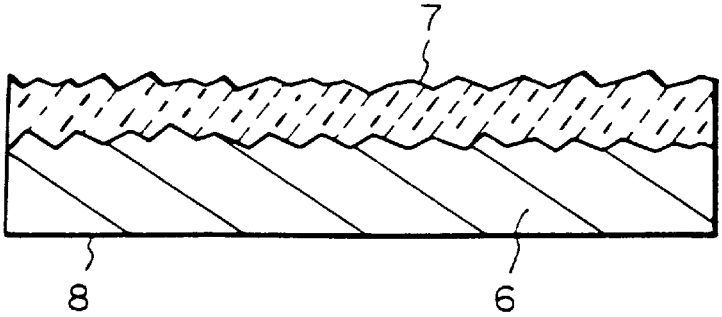
Fig. 3 PRIOR ART
FIG. 3 is a section showing a specific aluminum circuit board produced by a conventional method.

FIG. 3 shows a circuit board formed of aluminum and taught in Japanese Patent Laid-Open Publication No. 63-45895 mentioned earlier. As shown, the circuit board 8, is implemented as an aluminum substrate 6 carrying an oxide film 7 formed by anodization. Specifically, after the surface of the aluminum substrate 6 has been roughened to the maximum surface roughness Rmax of 8+3 μm, the oxide film 7 is formed on the roughened surface to a thickness of 3 μm to 20 μm by anodization. However, even with such a circuit board, it is difficult to achieve the desirable emissivity characteristic.

A series of extended researche and experiments showed that the emissivity increases in accordance with the thickness of the oxide film. In accordance with the present invention, the emissivity is enhanced when the oxide film formed on the outer periphery of fins, or fin assembly, is preferably thicker than 50 μm and has the maximum surface roughness of preferably greater than 12 μm, as will be described specifically later.

Figure 4:
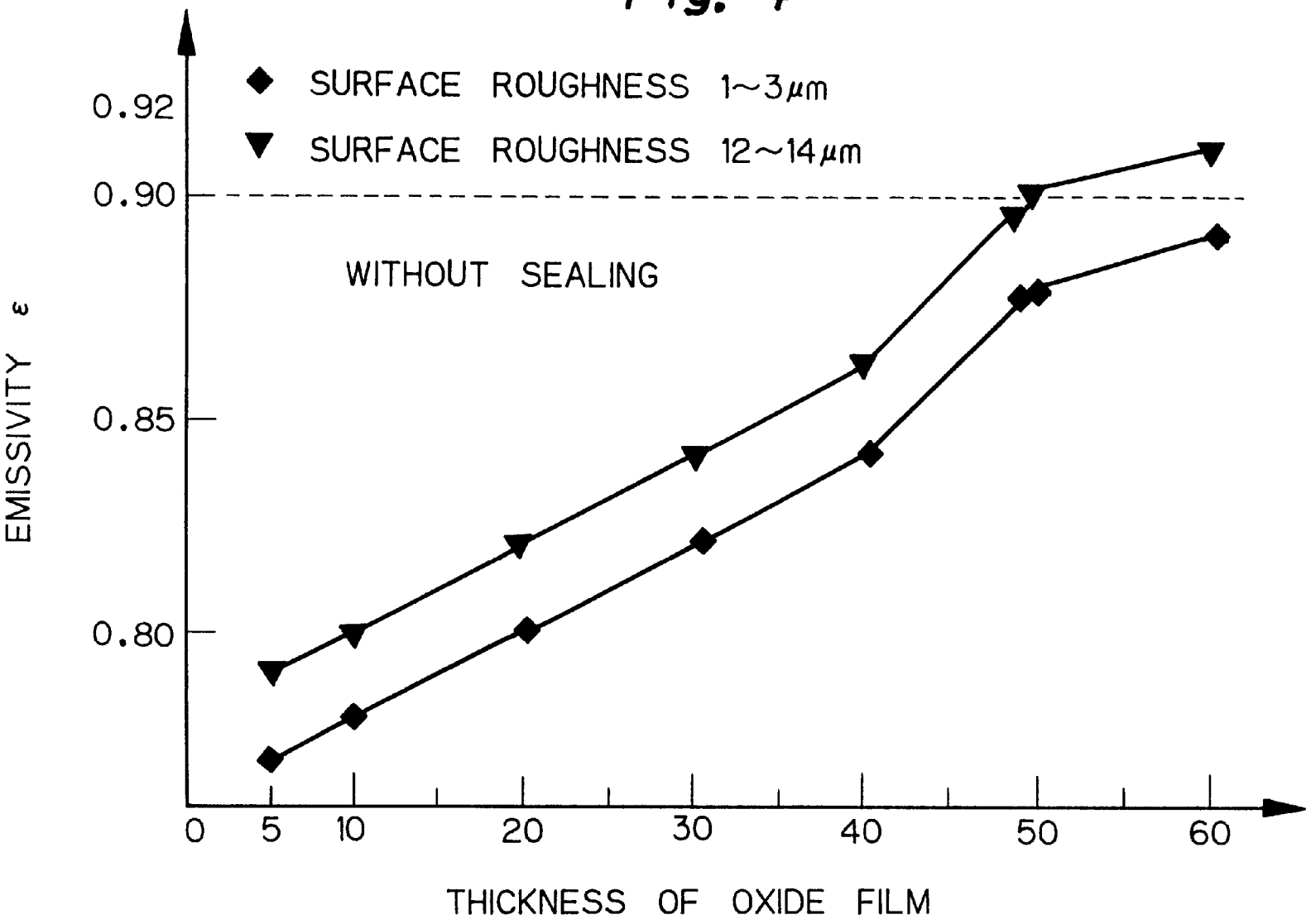
FIG. 4 is a graph showing a relation between the thickness of an oxide film (without sealing) formed by anodization and the emissivity, as determined by experiments.

FIG. 4 and Table 2 shown below indicate the results of experiments. FIG. 4 shows a relation between the thickness of the oxide film formed by anodization and the emissivity with respect to two different surface roughnesses (1 μm to 3 μm represented by squares, and 12 μm to 14 μm represented by triangles). Table 2 lists the results of experiments conducted with samples respectively having the maximum surface roughnesses Rmax of 1 μm to 3 μm, 12 μm to 14 μm, and 18 μm to 20 μm, and each having a particular oxide film thickness.

TABLE 2

| SAMPLE No. | SURFACE ROUGHNESS R max μm | FILM THICKNESS μm | SEALING | EMISSIVITY $\epsilon$ |
|---|---|---|---|---|
| B1 | 1~3 | 5 | no | 0.77 |
| B2 | 12~14 | 5 | no | 0.79 |
| B3 | 1~3 | 10 | no | 0.78 |
| B4 | 12~14 | 10 | no | 0.80 |
| B5 | 1~3 | 20 | no | 0.80 |
| B6 | 12~14 | 20 | no | 0.82 |
| B7 | 1~3 | 30 | no | 0.82 |
| B8 | 12~14 | 30 | no | 0.84 |
| B9 | 1~3 | 40 | no | 0.84 |
| B10 | 12~14 | 40 | no | 0.86 |
| B11 | 1~3 | 49 | no | 0.87 |
| B12 | 12~14 | 49 | no | 0.89 |
| B13 | 1~3 | 50 | no | 0.88 |
| B14 | 12~14 | 50 | no | 0.90 |
| B15 | 18~20 | 50 | no | 0.90 |
| B16 | 1~3 | 60 | no | 0.89 |
| B17 | 12~14 | 60 | no | 0.91 |
| B18 | 18~20 | 60 | no | 0.91 |

As FIG. 4 indicates, the emissivity sequentially increases as the thickness of the oxide film increases from 5 μm to 10 μm, 20 μm, 40 μm, 50 μm and so forth. However, the samples whose oxide films are thinner than 50 μpm (see sample B12 of Table 2), cannot satisfy the condition of $\epsilon \geqq 0.90$. To satisfy this condition, the oxide film should be 50 μm thick (see samples B12 and B17 of Table 2).

Figure 5:
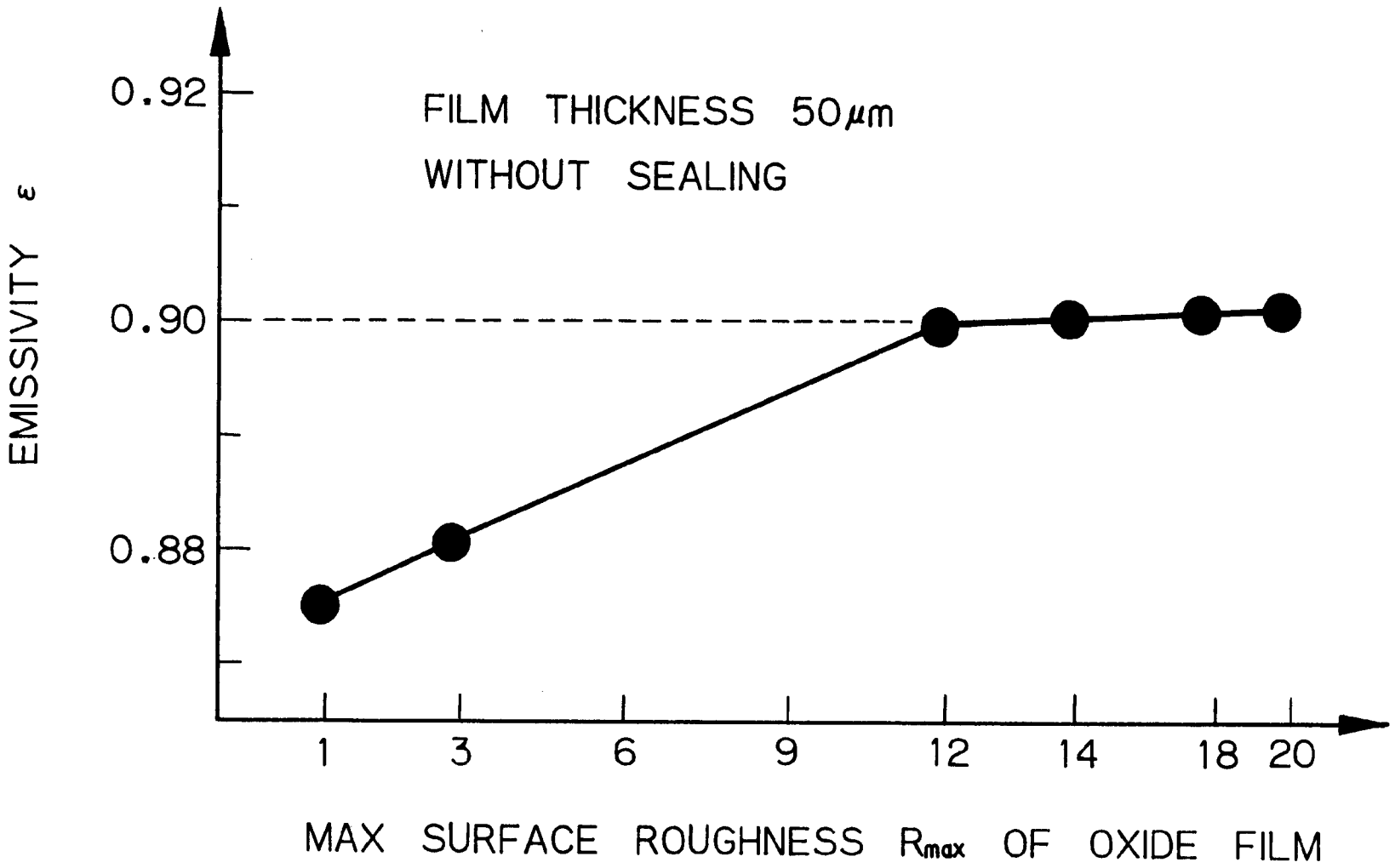
FIG. 5 is a graph showing a relation between the maximum surface roughness and the emissivity of a 50 μm thick oxide film (without sealing) formed by anodization, as also determined by experiments.

In accordance with the present invention, the maximum surface roughness Rmax of the oxide film should preferably be greater than 12 μm. Specifically, FIG. 5 shows experimental results relating to the maximum surface roughness Rmax and emissivity ε. As shown, so long as the roughness Rmax is less than 12 μm, the emissivity ε remains smaller than 0.9 although the oxide film may be 50 μm thick. Further, as sample B15 of Table 2 and FIG. 5 indicate, surface roughnesses greater than 12 μm contribute little to the increase in emissivity ε. These experimental results suggested that a satisfactory emissivity characteristic is achievable if the maximum surface roughness Rmax is 12 μm or above.

The oxide film formed by anodization is not limited to a sulfate film, chromate film, phosphate film, or oxalic acid film, as determined by experiments.

In accordance with the present invention the oxide film is thicker than 50 μm, and subjected to sealing. This is because sealing enhances the emissivity characteristic, as also determined by experiments.

Figure 6:
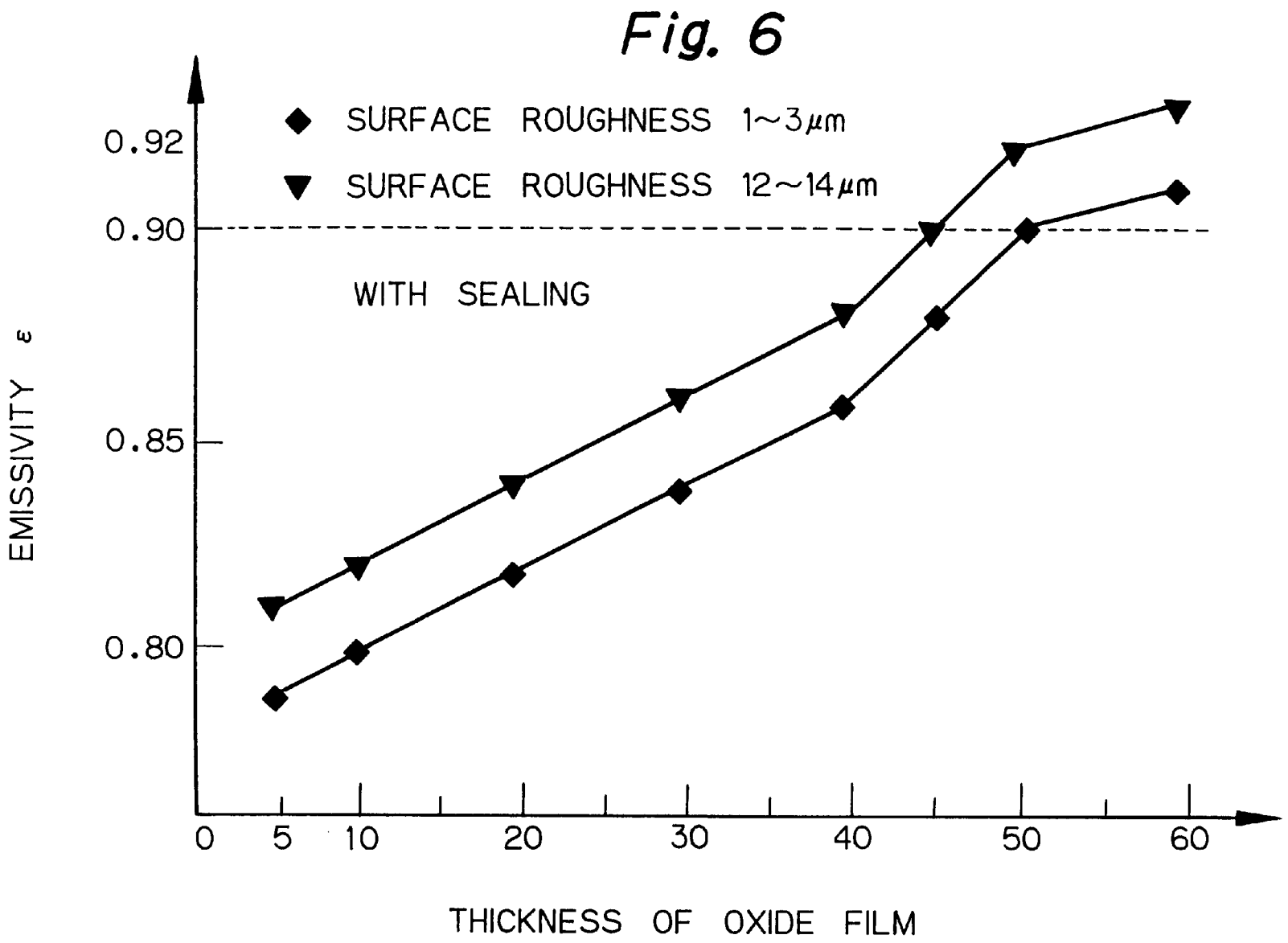
FIG. 6 is a graph showing a relation between the thickness and the emissivity of an oxide film (with sealing) formed by anodization, as also determined by experiments.

Table 3 shown below lists samples produced by subjecting the previously mentioned samples undergone oxidation to sealing. FIG. 6 is a graph representative of the results of Table 3.

TABLE 3

| SAMPLE No. | SURFACE ROUGHNESS R max μm | FILM THICKNESS μm | SEALING | EMISSIVITY ε |
|---|---|---|---|---|
| C1 | 1~3 | 5 | yes | 0.79 |
| C2 | 12~14 | 5 | yes | 0.81 |
| C3 | 1~3 | 10 | yes | 0.80 |
| C4 | 12~14 | 10 | yes | 0.82 |
| C5 | 1~3 | 20 | yes | 0.82 |
| C6 | 12~14 | 20 | yes | 0.84 |
| C7 | 1~3 | 30 | yes | 0.84 |
| C8 | 12~14 | 30 | yes | 0.86 |
| C9 | 1~3 | 40 | yes | 0.86 |
| C10 | 12~14 | 40 | yes | 0.88 |
| C11 | 1~3 | 45 | yes | 0.88 |
| C12 | 12~14 | 45 | yes | 0.90 |
| C13 | 18~20 | 45 | yes | 0.90 |
| C14 | 1~3 | 50 | yes | 0.90 |
| C15 | 12~14 | 50 | yes | 0.92 |
| C16 | 1~3 | 60 | yes | 0.91 |
| C17 | 12~14 | 60 | yes | 0.93 |
| C18 | 18~20 | 60 | yes | 0.93 |

In Table 3, samples identical in number as the samples of Table 2, e.g., samples C1 , C2 and C3 corresponding in number to the samples B1, B2 and B3, respectively, are the sealed versions of the samples B1–B3.

The above finding that sealing increases the emissivity by 0.02 to 0.03 without regard to the thickness of the oxide film or the surface roughness is entirely new in the art. That is, the structure including a 50 μm or thicker oxide film and subjected to sealing satisfies the emissivity ε of greater than 0.90 inclusive.

In accordance with the present invention, the oxide film formed on the outer periphery of fins by anodization is preferably 45 μm thick or above, and sealed, and provided with the maximum surface roughness Rmax of preferably 12 μm to 14 μm. This is because if Rmax is less than 12 μm, the relation of $\epsilon \geqq 0.90$ is not achievable although the film may be 45 μm thick, as shown in FIG. 7.

Figure 7:
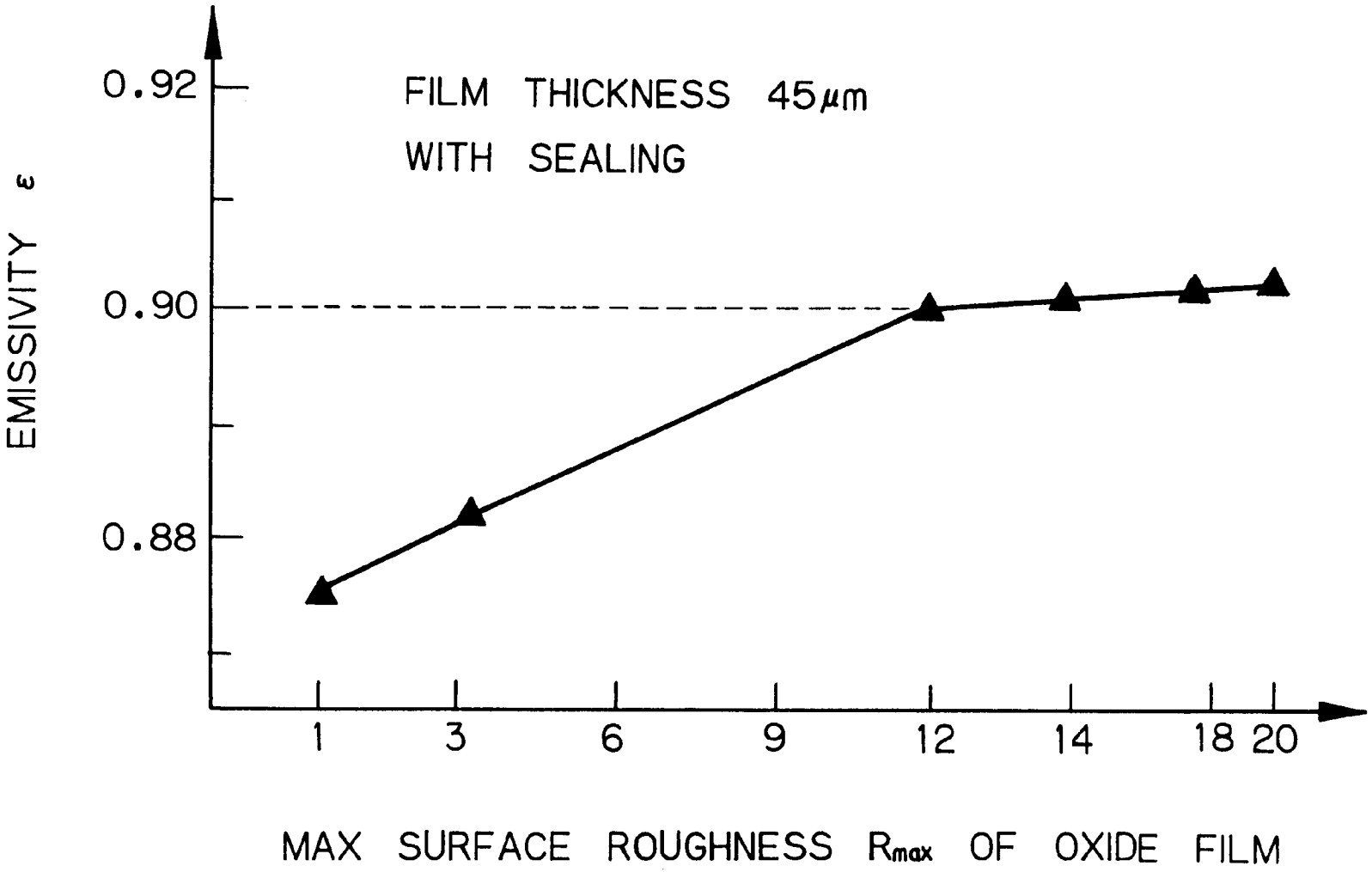
FIG. 7 is a graph showing a relation between the maximum surface roughness and the emissivity of a 45 μm oxide film (with sealing) formed by anodization, as also determined by experiments.

Specifically, FIG. 7 shows a relation between the maximum surface roughness Rmax and the emissivity ε particular to the 45 μm thick oxide film undergone sealing. As FIG. 7 indicates, it was found that samples sealed and provided with 45 μm oxide films whose Rmax is less than 12 μm cannot satisfy the condition of $\epsilon \geqq 0.90$.

As stated above, the collector of the travelling-wave tube in accordance with the present invention has an emissivity of 0.90 or above. This kind of collector can sufficiently radiate heat generated by the tube mounted on a satellite.

Preferred embodiments of the present invention will be described in detail hereinafter.

1ST EMBODIMENT

Samples belonging to a first embodiment of the present invention and comparative samples will be described which were subjected to preliminary tests using the fins of a collector. It is to be noted that samples which result in an emissivity of 0.9 or above belong to the embodiment while the samples which failed to do so are comparative samples. However, the present invention, of course, includes even samples capable of implementing, in principle, any desired emissivity (e.g. 0.89) in accordance with the thickness of the oxide film and preselected surface roughness.

3 μm thick aluminum plates formed of JIS 5052 alloy were prepared, and each was subjected to a particular treatment, as follows. The aluminum plates were each provided with the maximum surface roughness Rmax of 18 μm to 20 μm, 12 μm to 14 μm, or 1 μm to 3 μm. For the roughnesses of 18 μm to 20 μm, 12 μm to 14 μm, and 1 μm to 3 μm, use were respectively made of a mixture of water and alumina powder having a grain size of #50, a mixture of water and aluminum powder having a grain size of #120, and alumina powder having a grain size of #600. All the aluminum plates were roughened by blasting.

Oxide films were formed on the roughened surfaces of the aluminum plates by sulfuric anodization using an aqueous solution of 10% sulfur (volume ratio) of 10° C. For the electrolysis of the films, a current of 5 A was maintained constant while the duration of electrolysis was selected to be 3 minutes for the film thickness of 5 μm, six minutes for the film thickness of 10 μm, 12 minutes for the film thickness of 20 μm, 18 minutes for the film thickness of 30 μm, 24 minutes for the film thickness of 40 μm, 27 minutes for the film thickness of 45 μm, 29.4 minutes for the film thickness of 49 μm, 30 minutes for the film thickness of 50 μm, and 36 minutes for the film thickness of 60 μm. The results of experiments are listed in Tables 2 and 3 and shown in FIGS. 4 and 6. The details of the samples are as follows.

Referring to Table 2, a first sample B1 is produced by providing a 3 mm thick JIS 5052 alloy plate with the maximum surface roughness Rmax of 1 μm to 3 μm, and then anodizing it by the sulfur method to thereby form a 5 μm thick oxide film.

A second sample B2 is produced by providing a 3 mm thick JIS 5052 alloy plate with the maximum surface roughness Rmax of 12 μm to 14 μm, and then anodizing it by the sulfur method to thereby form a 5 μm thick oxide film.

A third sample B3 is produced by providing a 3 mm thick JIS 5052 alloy plate with the maximum surface roughness Rmax of 1 μm to 3 μm, and then anodizing it by the sulfur method to thereby form a 10 μm thick oxide film.

A fourth sample B4 is produced by providing a 3 mm thick JIS 5052 alloy plate with the maximum surface roughness Rmax of 12 μm to 14 μm, and then anodizing it by the sulfur method to thereby form a 10 μm thick oxide film.

A fifth sample B5 is produced by providing a 3 mm thick JIS 5052 alloy plate with the maximum surface roughness Rmax of 1 μm to 3 μm, and then anodizing it by the sulfur method to thereby form a 20 μm thick oxide film.

A sixth sample B6 is produced by providing a 3 mm thick JIS 5052 alloy plate with the maximum surface roughness Rmax of 12 μm to 14 μm, and then anodizing it by the sulfur method to thereby form a 20 μm thick oxide film.

A seventh sample B7 is produced by providing a 3 mm thick JIS 5052 alloy plate with the maximum surface roughness Rmax of 1 μm to 3 μm, and then anodizing it by the sulfur method to thereby form a 30 μm thick oxide film.

An eighth sample B8 is produced by providing a 3 mm thick JIS 5052 alloy plate with the maximum surface roughness Rmax of 12 μm to 14 μm, and then anodizing it by the sulfur method to thereby form a 30 μm thick oxide film.

A ninth sample B9 is produced by providing a 3 mm thick JIS 5052 alloy plate with the maximum surface roughness Rmax of 1 μm to 3 μm, and then anodizing it by the sulfur method to thereby form a 40 μm thick oxide film.

A tenth sample B10 is produced by providing a 3 mm thick JIS 5052 alloy plate with the maximum surface roughness Rmax of 12 μm to 14 μm, and then anodizing it by the sulfur method to thereby form a 40 μm thick oxide film.

An eleventh sample B11 is produced by providing a 3 mm thick JIS 5052 alloy plate with the maximum surface roughness Rmax of 1 μm to 3 μm, and then anodizing it by the sulfur method to thereby form a 49 μm thick oxide film.

A twelfth sample B12 is produced by providing a 3 mm thick JIS 5052 alloy plate with the maximum surface roughness Rmax of 12 μm to 14 μm, and then anodizing it by the sulfur method to thereby form a 49 μm thick oxide film.

A thirteenth sample B13 is produced by providing a 3 mm thick JIS 5052 alloy plate with the maximum surface roughness Rmax of 1 μm to 3 μm, and then anodizing it by the sulfur method to thereby form a 50 μm thick oxide film.

A fourteenth sample B14 is produced by providing a 3 mm thick JIS 5052 alloy plate with the maximum surface roughness Rmax of 12 μm to 14 μm, and then anodizing it by the sulfur method to thereby form a 50 μm thick oxide film.

A fifteenth sample B15 is produced by providing a 3 mm thick JIS 5052 alloy plate with the maximum surface roughness Rmax of 18 μm to 20 μm, and then anodizing it by the sulfur method to thereby form a 50 μm thick oxide film. 5 A sixteenth sample B16 is produced by providing a 3 mm thick JIS 5052 alloy plate with the maximum surface roughness Rmax of 1 μm to 3 μm, and then anodizing it by the sulfur method to thereby form a 60 μm thick oxide film.

A seventeenth sample B17 is produced by providing a 3 mm thick JIS 5052 alloy plate with the maximum surface roughness Rmax of 12 μm to 14 μm, and then anodizing it by the sulfur method to thereby form a 60 μm thick oxide film.

An eighteenth sample B18 is produced by providing a 3 mm thick JIS 5052 alloy plate with the maximum surface roughness Rmax of 18 μm to 20 μm, and then anodizing it by the sulfur method to thereby form a 60 μm thick oxide film.

Referring to Table 3, a first sample C1 is produced by providing a 3 mm thick JIS 5052 alloy plate with the maximum surface roughness Rmax of 1 μm to 3 μm, then anodizing it by the sulfur method to thereby form a 5 μm thick oxide film, and then sealing the film.

A second sample C2 is produced by providing a 3 mm thick JIS 5052 alloy plate with the maximum surface roughness Rmax of 12 μm to 14 μm, then anodizing it by the sulfur method to thereby form a 5 μm thick oxide film, and then sealing the film.

A third sample C3 is produced by providing a 3 mm thick JIS 5052 alloy plate with the maximum surface roughness Rmax of 1 μm to 3 μm, then anodizing it by the sulfur method to thereby form a 10 82 m thick oxide film, and then sealing the film.

A fourth sample C4 is produced by providing a 3 mm thick JIS 5052 alloy plate with the maximum surface roughness Rmax of 12 μm to 14 μm, then anodizing it by the sulfur method to thereby form a 10 μm thick oxide film, and then sealing the film.

A fifth sample C5 is produced by providing a 3 mm thick JIS 5052 alloy plate with the maximum surface roughness Rmax of 1 μm to 3 μm, then anodizing it by the sulfur method to thereby form a 20 μm thick oxide film, and then sealing the film.

A sixth sample C6 is produced by providing a 3 mm thick JIS 5052 alloy plate with the maximum surface roughness Rmax of 12 μm to 14 μm, then anodizing it by the sulfur method to thereby form a 20 μm thick oxide film, and then sealing the film.

A seventh sample C7 is produced by providing a 3 mm thick JIS 5052 alloy plate with the maximum surface roughness Rmax of 1 μm to 3 μm, then anodizing it by the sulfur method to thereby form a 30 μm thick oxide film, and then sealing the film.

An eighth sample C8 is produced by providing a 3 mm thick JIS 5052 alloy plate with the maximum surface roughness Rmax of 12 μm to 14 μm, then anodizing it by the sulfur method to thereby form a 30 μm thick oxide film, and then sealing the film.

A ninth sample C9 is produced by providing a 3 mm thick JIS 5052 alloy plate with the maximum surface roughness Rmax of 1 μm to 3 μm, then anodizing it by the sulfur method to thereby form a 40 μm thick oxide film, and then sealing the film.

A tenth sample C10 is produced by providing a 3 mm thick JIS 5052 alloy plate with the maximum surface roughness Rmax of 11 μm to 14 μm, then anodizing it by the sulfur method to thereby form a 40 μm thick oxide film, and then sealing the film.

An eleventh sample C11 is produced by providing a 3 mm thick JIS 5052 alloy plate with the maximum surface roughness Rmax of 1 μm to 3 μm, then anodizing it by the sulfur method to thereby form a 45 μm thick oxide film, and then sealing the film.

A twelfth sample C12 is produced by providing a 3 mm thick JIS 5052 alloy plate with the maximum surface roughness Rmax of 12 μm to 14 μm, then anodizing it by the sulfur method to thereby form a 45 μm thick oxide film, and then sealing the film.

A thirteenth sample C13 is produced by providing a 3 mm thick JIS 5052 alloy plate with the maximum surface roughness Rmax of 18 μm to 20 μm, then anodizing it by the sulfur method to thereby form a 45 μm thick oxide film, and then sealing the film.

A fourteenth sample C14 is produced by providing a 3 mm thick JIS 5052 alloy plate with the maximum surface roughness Rmax of 1 μm to 3 μm, then anodizing it by the sulfur method to thereby form a 50 μm thick oxide film, and then sealing the film.

A fifteenth sample C15 is produced by providing a 3 mm thick JIS 5052 alloy plate with the maximum surface roughness Rmax of 12 μm to 14 μm, then anodizing it by the sulfur method to thereby form a 50 μm thick oxide film, and then sealing the film.

A sixteenth sample C16 is produced by providing a 3 mm thick JIS 5052 alloy plate with the maximum surface roughness Rmax of 1 μm to 3 μm, then anodizing it by the sulfur method to thereby form a 60 μm thick oxide film, and then sealing the film.

A seventeenth sample C17 is produced by providing a 3 mm thick JIS 5052 alloy plate with the maximum surface roughness Rmax of 12 μm to 14 μm, then anodizing it by the sulfur method to thereby form a 60 μm thick oxide film, and then sealing the film.

An eighteenth sample C18 is produced by providing a 3 mm thick JIS 5052 alloy plate with the maximum surface roughness Rmax of 18 μm to 20 μm, then anodizing it by the sulfur method to thereby form a 60 μm thick oxide film, and then sealing the film.

The emissivities of the samples B14 and B15 and those of the samples C12–C16 are shown in Tables 2 and 3, respectively.

In the illustrative embodiment, the JIS 5052 alloy aluminum plate is blasted by the alumina powder and water mixture. The sample B14 with the maximum surface roughness of 12 μm to 14 μm is anodized to form the 50 μm thick oxide film. The sample B15 with Rmax of 18 μm to 20 μm is anodized to form the 50 m thick oxide film. The sample B17 with Rmax of 12 μm to 14 μm is anodized to form the 60 μm thick oxide film. Further, the sample B18 with Rmax of 18 μm to 20 μm is anodized to form the 60 μm thick oxide film. All these samples achieve emissivities ϵ higher than 0.90 inclusive.

Even with the samples C13–C18 having oxide films thicker than 50 μm and sealed, emissivities of 0.90, 0.90, 0.92, 0.91, 0.93 and 0.93 are respectively attained. Further, with the sample C12 having the maximum surface roughness Rmax of 12 μm to 14 μm and a sealed 45 μm thick oxide film, an emissivity ϵ of 0.90 is achieved.

It will be seen from the above that in the illustrative embodiment the collector implements an emissivity ϵ greater than or equal to 0.90.

2ND EMBODIMENT

Figure 8A:
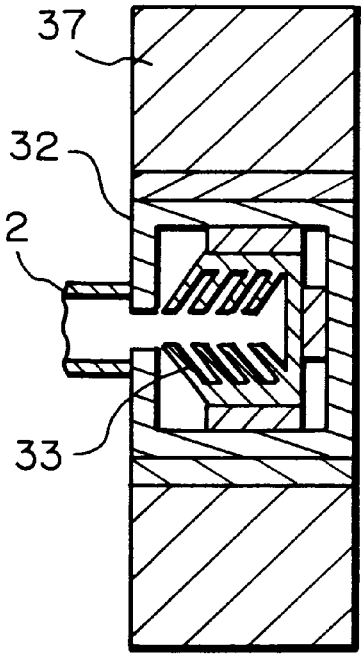
FIG. 8A is a section of a collector included in a radiation cooling type travelling-wave tube and embodying the present invention.
Figure 8B:
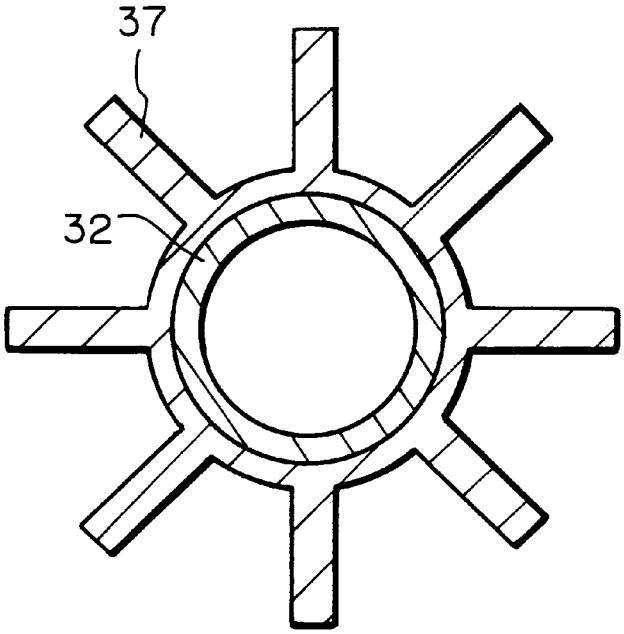
FIG. 8B is a plan view of the embodiment.
Figure 9:
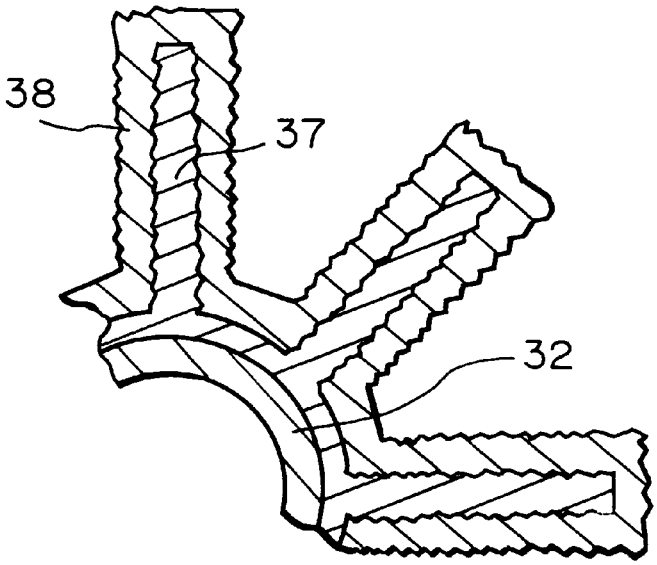
FIG. 9 is a fragmentary enlarged section of the embodiment.

Referring to FIGS. 8A, 8B and 9, a second embodiment of the present invention will be described. As shown, an aluminum rod formed of JIS 5052 alloy and having a diameter of 120 mm is machined to form a plurality of fins, or fin assembly, 37 around a collector core 32. The outer periphery of the fins 37 is blasted by a mixture of water and alumina powder whose grain size is #120, and provided with the maximum surface roughness Rmax of 12 μm to 14 μm thereby. The surface of the fin assembly 37 and that of the collector core 32 contacting each other are, e.g., mirror-finished. There are also shown in FIG. 8A a wave delay circuit 2 and collector electrodes 33. As shown in FIG. 9, a 50 μm thick oxide film 38 is formed on the roughened outer periphery of the fins 37 by the sulfur method, and then sealed by a hot water method. For the anodization, electrolysis was effected for 30 minutes with a 10% (volume ratio) aqueous solution of sulfur and a current of 5 A. With this alternative embodiment, an emissivity ϵ of 0.9 is achievable, as determined by experiments.

In summary, in accordance with the present invention, heat generated by the collector of a travelling-wave tube while the tube is mounted on a satellite can be smoothly radiated into space. The collector therefore achieves an improved heat radiation characteristic when built in a high output travelling-wave tube for a satellite application. In addition, the collector of the present invention has a weight only one half of the weight of the conventional collector having the previously stated ceramic coating film. This is due to the material and weight of the conventional collector core and the coating film which is as thick as 500 μm.

Various modifications will become possible for those skilled in the art after receiving the teachings of the present disclosure without departing from the scope thereof. For example, while the embodiments have concentrated on JIS 5052 aluminum alloy, the present invention is similarly practicable with, e.g., JIS 1050, JIS 3004 or similar aluminum alloy.

What is claimed is:

1. A collector of a travelling-wave tube comprising:

a collector core; and a fin structure provided on an outer periphery of said collector core, an oxide film having thickness preselected in accordance with an emissivity of 0.9 or higher is provided, by anodization, on an outer periphery of said fin structure and provided with a preselected maximum surface roughness.

2. A collector of a travelling-wave tube comprising:

a collector core; and a fin structure provided on an outer periphery of said collector core, an oxide film having a thickness of 50 μm is provided, by anodization, on an outer periphery of said fin structure and provided with a maximum surface roughness between 12 μm and 14 μm.

3. A collector of a travelling-wave tube comprising:

a collector core; and a fin structure provided on an outer periphery of said collector core, an oxide film having a thickness of 60 μm is provided, by anodization, on an outer periphery of said fin structure and provided with a maximum surface roughness between 12 μm and 18 μm.

* * * * *